US005295890A

United States Patent [19]

Myers

[11] Patent Number: 5,295,890

[45] Date of Patent: Mar. 22, 1994

[54] REMOTELY CONTROLLED TOY VEHICLE WITH WATER EJECTION CAPABILITIES

[76] Inventor: Jeff D. Myers, 12629 N. Tatum Blvd. Suite 206, Phoenix, Ariz. 85032

[21] Appl. No.: 5,793

[22] Filed: Jan. 19, 1993

[51] Int. Cl.[5] ..... A63H 29/10; A63H 23/04; A63H 17/00; A63H 30/04

[52] U.S. Cl. ..... 446/176; 446/155; 446/435; 446/456; 446/475

[58] Field of Search ..... 446/176, 180, 154, 155, 446/267, 424, 429, 431, 433, 435, 454, 456, 473, 475, 483

[56] References Cited

U.S. PATENT DOCUMENTS

| | | | |
|---|---|---|---|
| 691,266 | 1/1902 | Hill | 446/180 |
| 819,653 | 5/1906 | Hawke | 446/180 X |
| 2,119,641 | 6/1938 | Marx | 446/475 X |
| 3,561,156 | 2/1971 | Tobias et al. | 446/154 X |
| 3,613,298 | 10/1971 | Okonski | 446/154 |
| 3,869,825 | 3/1975 | Heberlein | 446/433 |
| 4,226,292 | 10/1980 | Monte et al. | 446/433 X |
| 4,270,307 | 6/1981 | Arigaya | 446/154 |
| 4,612,472 | 9/1986 | Kakizaki et al. | 446/454 X |
| 4,768,681 | 9/1988 | Dean et al. | 446/475 X |
| 4,826,465 | 5/1989 | Fleischmann | 446/155 X |
| 4,903,864 | 2/1990 | Sirhan | 446/475 X |
| 5,071,387 | 12/1991 | Pottick | 446/475 |

*Primary Examiner*—David N. Muir
*Attorney, Agent, or Firm*—Warren F.B. Lindsley

[57] ABSTRACT

Apparatus for generating a stream or burst of water through a vehicle mounted water cannon by a remote transmitter which generates signals for receipt by a receiver mounted on the vehicle for controlling the stream or burst of water.

5 Claims, 3 Drawing Sheets

REMOTELY CONTROLLED TOY VEHICLE WITH WATER EJECTION CAPABILITIES

BACKGROUND OF THE INVENTION

This invention relates to toys and more particularly to toys that are model machines, such as, inter alia, sophisticated radio controlled electric motor actuated water cannon dispensing tanks, trucks, cars, airplanes and other types of vehicles.

Toys from the earliest days have been a necessary constituent of human health and development. Competition has produced countless ingenious contrivances which are model machines, such as steam-engines, mobiles, tanks, etc. many remotely controlled by radio transmitter receiver equipment for movement and equipment functions.

DESCRIPTION OF THE PRIOR ART

Many toys are model machines of known equipment and particularly objects such as cars, trucks and various military vehicles. Some of the military vehicles have been known to dispense projectiles but none are known which mount a water cannon and selectively dispense a self contained water supply.

SUMMARY OF THE INVENTION

This invention relates to water dispensing model vehicles which may be radio controlled.

It is, therefore, one object of this invention to provide a new and improved model vehicle that selectively dispenses a projectile of water.

Another object of this invention is to provide a new and improved remotely controlled motor driven military type vehicle that selectively dispenses a stream or burst of water.

A still further object of this invention is to provide a new and improved self powered toy that dispenses a liquid such as water.

A still further object of this invention is to provide a model machine such as a self powered vehicle that contains its own water supply and pressurizing means which may be programmed to selectively dispense a stream or burst of water.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
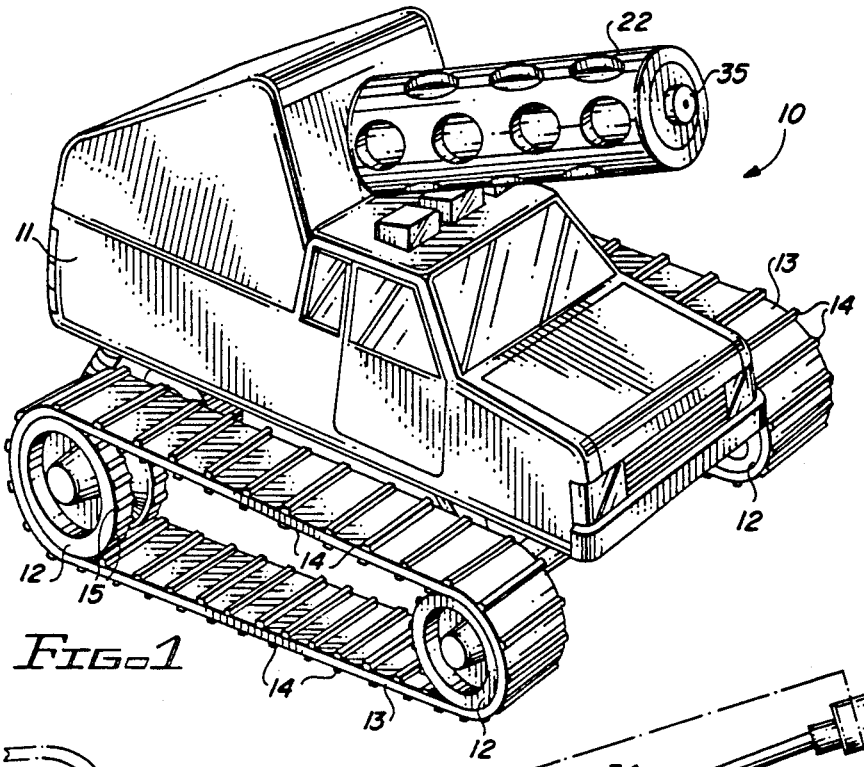
FIG. 1 is a perspective view of a model track driven cannon carrying military type truck embodying the invention.
Figure 2:
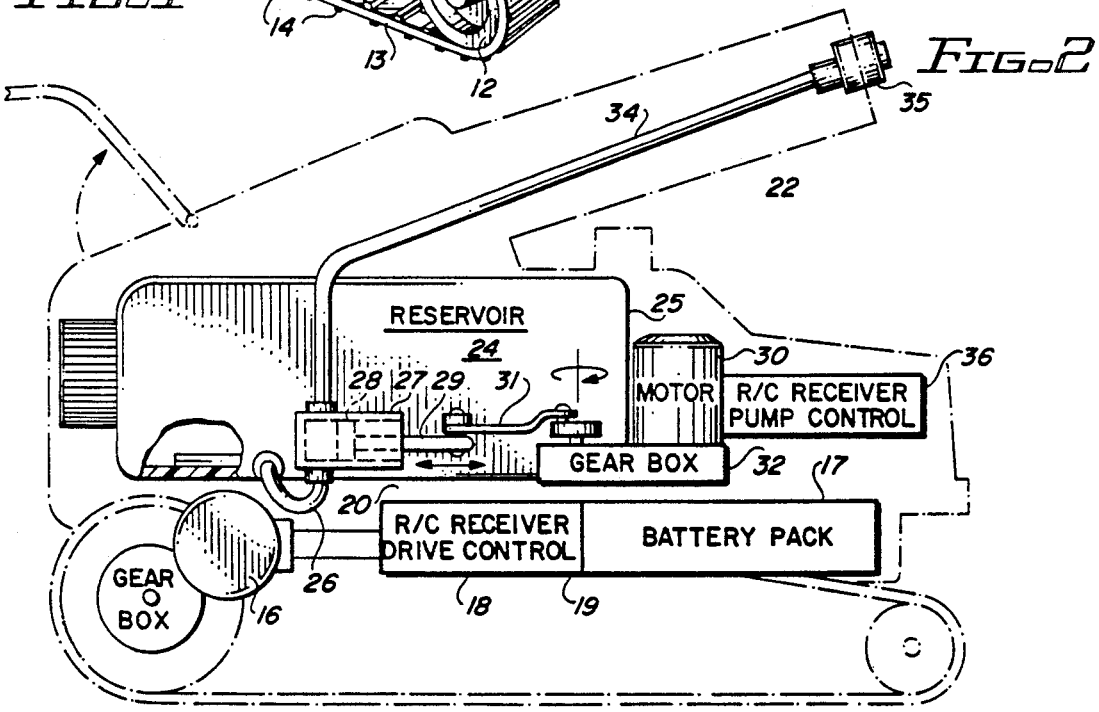
FIG. 2 is a cross sectional view of FIG. 1.
Figure 3:
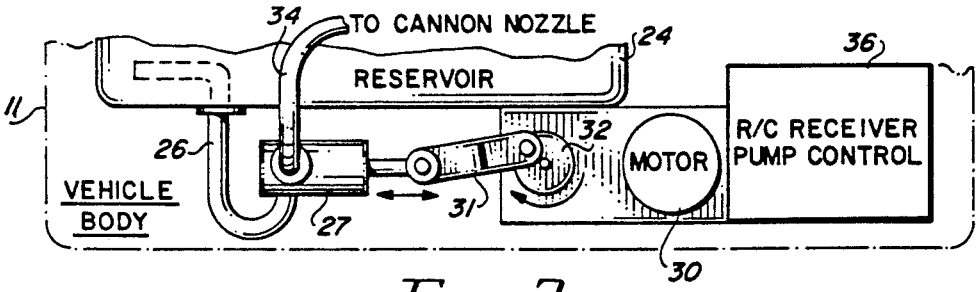
FIG. 3 is a partial top view of the water controlled mechanism shown in FIG. 2.

Referring more particularly to the drawings by characters of reference, FIGS. 1–3 disclose a track mounted vehicle 10 comprising a truck like body 11 the wheels 12 of which drive a pair of tracks 13. Tracks 13 are provided with a plurality of spaced parallelly arranged ridges or treads 14, 14' on the outside and inner surface thereof that extends laterally there-across for engaging with cooperating grooves 15 in the periphery of wheels 12 or vice versa, as well known in the art.

It should be noted that the term vehicle is intended to mean all forms of model cars, trucks, boats, aircraft and the like.

Vehicle 10 is driven by a pair of twin motors 16 which may be a Mabuchi product with one motor connected to each of the wheels of the vehicle for independent or joint rotation thereof in either direction of rotation.

Motors 16 are interconnected to a battery pack 17 through a radio controlled receiver 18. The battery pack may be a rechargeable 9.6 volt NiCd Tyco Industries, Inc.'s of Moorestown, N.J. product or 7.2 or other multi battery configuration of various voltages from the same or different companies. An on-off switch 19 forming a part of the radio controlled receiver 18 may be used for controlling the energization of motors 16. An antenna 20 also forming a part of the radio controlled receiver 18 is utilized for receiving signals from a suitable transmitter 21 diagrammatically shown in FIG. 8 but well known in the art.

The transmitter comprises a number of controls the adjustment of which manipulates the various parts of the vehicle during operation. Although transmitters may vary between different manufacturers and even between different models of the same manufacturer, all have some similar controls for operating toy vehicles.

Figure 7:
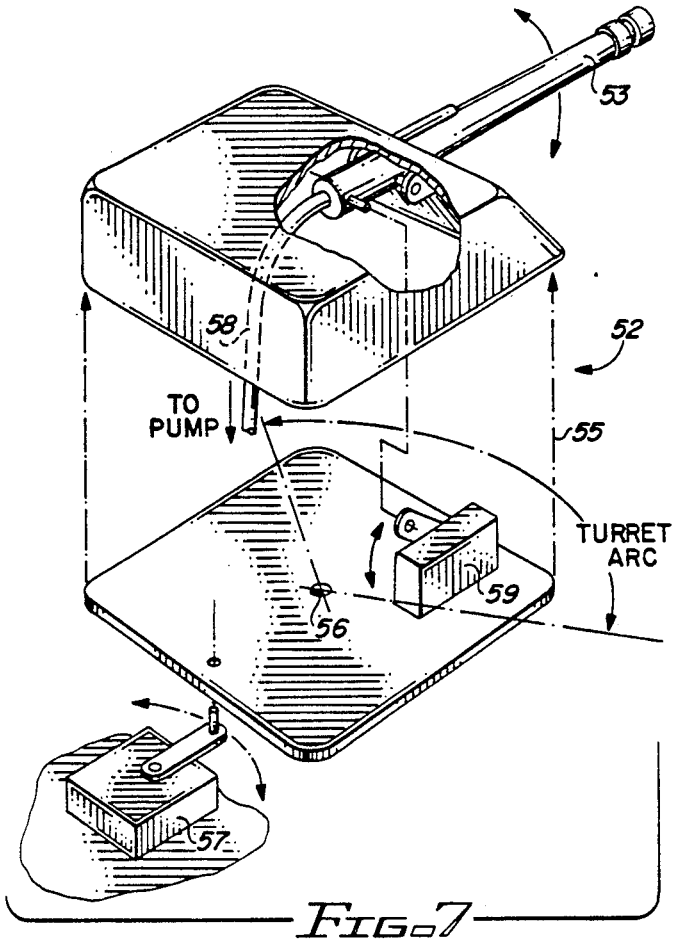
FIG. 7 is a diagrammatic illustration partially in section of a water cannon and its controls for mounting on a vehicle.
Figure 8:
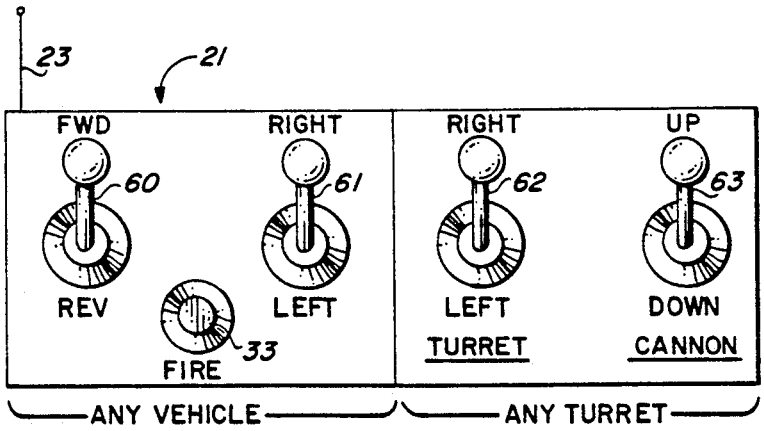
FIG. 8 is a diagrammatic illustration of a remote control panel for the vehicles shown in FIGS. 1–7.

As shown in FIGS. 7 and 8, transmitter 21 provides drive wheel control for vehicle 10 to direct its movement pattern and also as hereinafter explained the movement and control of a water cannon 22 mounted thereon. An antenna 23 is suitably mounted on the outside of the housing of transmitter 21 for broadcasting control signals to the receiver 18 of the model truck, in a well known manner.

The primary job of the operator is to control and maneuver the vehicle, i.e., to direct its movement pattern. The direction and speed of the vehicle is determined by the surface on which it travels.

Figure 5A:
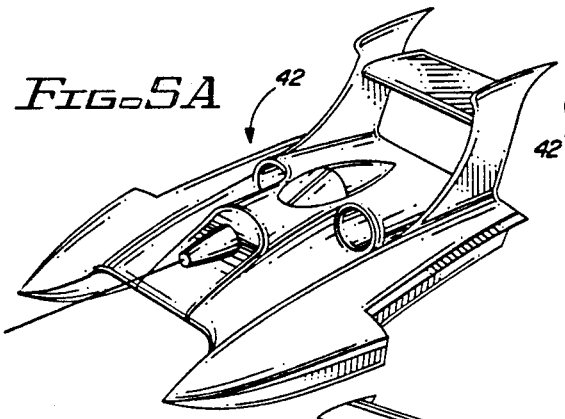
FIGS. 5A–5D illustrate perspective views of various vehicles on which a water controlled cannon may be mounted.
Figure 5B:
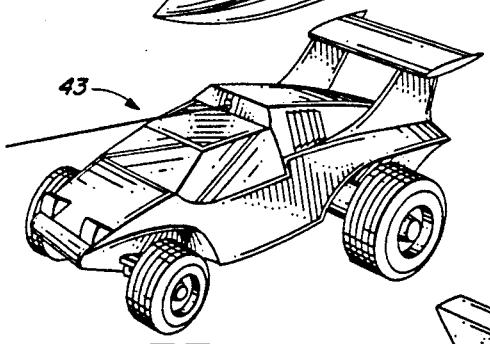
Figure 5D:
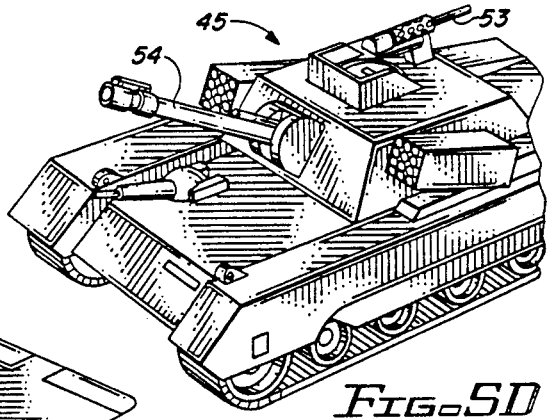

In accordance with the invention claimed, the water cannon mounted on truck 10 is intended to simulate a cannon usually found on a tank 24 as shown in FIG. 5D. This cannon may be movable, as shown, in FIG. 5D or fixedly mounted as shown in FIGS. 1 and 2. In either instance, the cannon is used to disperse a stream or burst of water 24 from a reservoir 25 forming a part of vehicle 10.

This stream or burst of water 24 is drawn through a pipeline 26 by a hydraulic cylinder 27 the piston 28 and piston rod 29 of which are operable by a motor 30 through a crank 31 and gear box 32 in the usual manner.

When an operator transmits a given signal from transmitter 21 by switch 33 identified as FIRE in FIG. 8, D.C. motor 30 actuates piston rod 29 to the right as shown in FIG. 2 which causes the hydraulic cylinder 27 to fill with water and upon their movement to the right forces the water from the hydraulic cylinder to flow under pressure through pipeline 34 which is mounted in cannon 22 coaxially thereof and through a nozzle 35 to a selected target.

Motor 30 may be controlled by a remote controlled receiver 36 which is energized and controlled by transmitter 21.

Thus, transmitter 21 may control the functions of driving the vehicle in a controlled pattern and selectively firing the cannon to discharge a stream, slug or burst of water. More than one transmitter may be used if so desired. Different channels or frequencies of a transmitter can be used to control the cannon's actions as well as functions of the vehicle.

Figure 4:
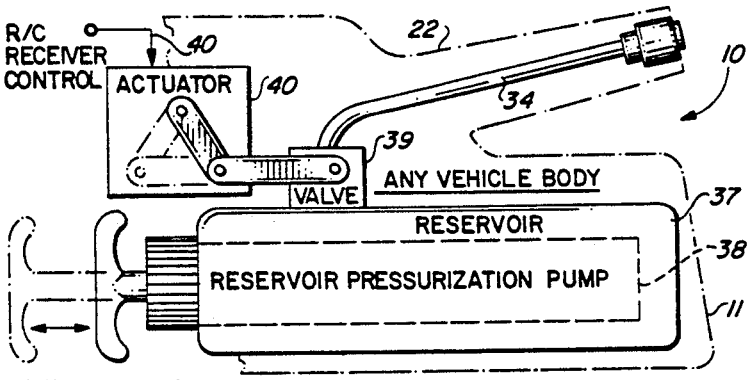
FIG. 4 is a diagrammatic illustration of the pressurizing pump and valve control of the water dispensing cannon shown in FIGS. 1–3.

FIG. 4 discloses a modification of the structure shown in FIGS. 1-3 wherein a reservoir 37 may contain a hand actuated pump 38 built therein which is pressurized by a piston, not shown. A valve 39 interconnecting reservoir 37 with pipeline 34 is radio controlled by a signal 40 received from transmitter 21 which energizes actuator 41 which selectively opens and closes valve 39 in a known manner.

It should be noted that the water dispensing control means shown in FIG. 4 may be mounted on any type of vehicle and still fall within the scope of this invention even though it is shown mounted on vehicle 10.

FIGS. 5A-5D illustrate various vehicles on which a water cannon may be mounted and remotely controlled by a radio transmitter mechanism.

Figure 5C:
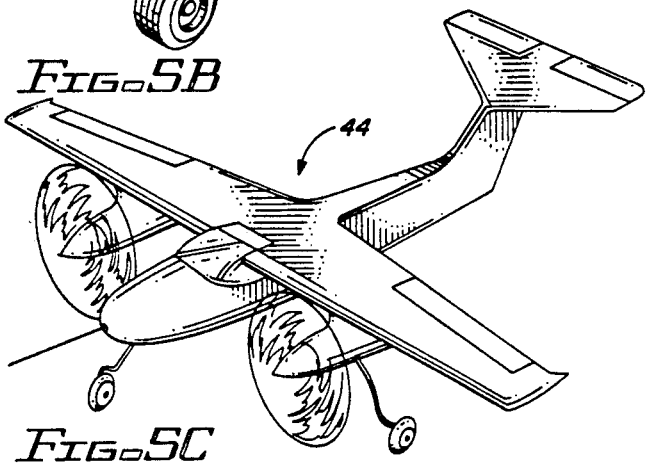

FIG. 5A illustrates a hydro type boat 42, FIG. 5B a passenger car 43, FIG. 5C an airplane 44 and FIG. 5D a tank 45. FIGS. 1-3 illustrate the means and hardware for mounting on the vehicles shown in FIGS. 5A-5D.

Figure 6:
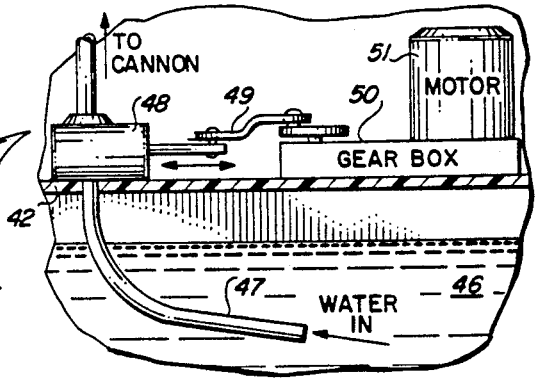
FIG. 6 is a cross sectional partial view of a power boat chassis supporting the controls for a water dispensing cannon.

FIG. 6 illustrates a means for boat 42 to draw water 46 through a pipeline or tube 47 into a hydraulic cylinder 48 actuated by a crank 49 and gear box 50 by a motor 51. Motor 51 may be radio controlled in the manner heretofore explained for the structure shown in FIGS. 1-3. The water drawn into hydraulic cylinder 48 and pressurized and controlled by motor 51 is dispersed through pipeline 34 of cannon 22 which is mounted on any one of the vehicles shown in FIGS. 4A-4D.

FIG. 7 diagrammatically illustrates a module 52 containing a water dispensing cannon 53 that may be mounted on tank 45 without changing the projectile dispensing cannon 54 forming a part of the tank's armor.

The module 52 comprises a housing or turret 55 pivotally movable about point 56 by a crank type or hydraulic actuator 57 mounted on tank 45 for arcuately moving the tank's turret over a predetermined path resulting in the water cannon 53 being moved in a predetermined arc.

The water cannon is connected through a pipe line or tube 58 to a suitable source of water under pressure such as the hydraulic systems shown in FIGS. 2, 3 and 4. As diagrammatically shown in FIG. 7, cannon 53 may be elevated or depressed in a vertical manner by an actuator 59 that is radio controlled.

FIG. 8 illustrates the hand controls or switches for operating the vehicle, turrets and water cannon mounted on any of the vehicles disclosed. Although hydraulic systems are shown and described, pneumatic actuating systems may be used where practical and fall within the scope of this invention.

The transmitter 21 shown in FIGS. 8 discloses a toggle switch 60 that controls the energization of the drive motors of the vehicles such as the truck shown in FIGS. 1-3 that causes forward and reverse operation of the vehicle while toggle switch 61 results in the left or right movement of the vehicle in a well known manner.

Toggle switch 62 causes right and left movement of the turret housing 55 while toggle switch 63 results in up and down or vertical movement of the water cannon.

Although but a few embodiments of the invention have been illustrated and described, it will be apparent to those skilled in the art that various changes and modifications may be made therein without departing from the spirit of the invention or from the scope of the appended claims.

What is claimed is:

1. A model vehicle for generating a stream or burst of water under control of a remote transmitter transmitting radio signals to a receiver on board the vehicle comprising:

vehicle movement means featuring a drive train and propulsion motor an on-board container being a source of water, a piston actuated cylinder pump comprising a piston and piston rod mounted on board the model vehicle, a water cannon mounted on said vehicle, pipe means for interconnecting said piston actuated cylinder pump with said cannon and said source of water, a transmitter for transmitting radio signals to said vehicle, a receiver mounted on board said vehicle for receiving a first signal from said transmitter, motor means mounted on said vehicle and actuated by said first signal for actuating said piston and piston rod to disperse a stream or burst of water from said source through said cannon, said motor means comprising a D.C. motor connected through a drive means to said piston actuated cylinder, and a first control means mounted on board said vehicle for receiving a second signal from said transmitter for controlling the vehicle movement means of said vehicle.

2. The model vehicle set forth in claim 1 wherein:

said source of water comprises a reservoir mounted on board said vehicle.

3. The model vehicle set forth in claim 1 wherein:

said vehicle movement means comprises a second D.C. motor and a battery.

4. The model vehicle set forth in claim 1 wherein:

said piston actuated cylinder pump comprises a hand movable piston for charging said cylinder pump, and a value means connected to said cylinder pump and actuated by said first signal for receiving water under pressure from said cylinder pump for movement through and out of said cannon.

5. The model vehicle set forth in claim 1 wherein:

said water cannon is pivotally mounted on said vehicle, and a second control means mounted on board said vehicle for controlling pivotal movement of said cannon.

* * * * *

UNITED STATES PATENT AND TRADEMARK OFFICE

CERTIFICATE OF CORRECTION

PATENT NO. : 5,295,890

DATED : March 22, 1994

INVENTOR(S) : Jeff D. Myers

It is certified that error appears in the above-identified patent and that said Letters Patent is hereby corrected as shown below:

Column 4, line 5, cancel "value" and substitute --valve--.

Signed and Sealed this

Second Day of August, 1994

Bruce Lehman

*Attest:*

BRUCE LEHMAN

*Attesting Officer*

*Commissioner of Patents and Trademarks*